United States Patent [19]

Shuler

[11] Patent Number: 4,461,205

[45] Date of Patent: Jul. 24, 1984

[54] COMBINATION LIGHTING AND FILTERING UNIT FOR A CLEAN ROOM

[75] Inventor: Bernard R. Shuler, Anchorage, Ky.

[73] Assignee: Allis-Chalmers Corp., Milwaukee, Wis.

[21] Appl. No.: 403,784

[22] Filed: Jul. 30, 1982

[51] Int. Cl.[3] ..... F24F 7/00; B01D 39/08; B01D 50/00; H01G 1/08

[52] U.S. Cl. ..... 98/40 DL; 55/505; 55/484; 362/218; 362/294; 362/373

[58] Field of Search ..... 98/40 DL, 40 D, 33 R; 55/484, 385 A, DIG. 29, DIG. 31, DIG. 18, 505; 362/218, 294, 373

[56] References Cited

U.S. PATENT DOCUMENTS 3,715,578 2/1973 Wood et al. ..... 240/9 R
4,061,082 12/1977 Shuler ..... 98/40 D
4,088,463 5/1978 Smith ..... 55/385 A X
4,333,750 6/1982 Helmus et al. ..... 98/40 DL X
4,372,853 2/1983 Mayfield ..... 55/505 X

*Primary Examiner*—William E. Wayner
*Assistant Examiner*—J. Sollecito
*Attorney, Agent, or Firm*—Arthur L. Nelson

[57] ABSTRACT

A combination lighting and filtering unit adapted to be mounted in the ventilated ceiling structure of a clean room wherein clean air is directed downwardly into the interior of the room. The unit includes a flow-through light housing having a plurality of florescent light bulbs secured across its interior, sized to overlie and enclose one of a plurality of apertures provided in a mounting grid in the ceiling structure, and an interchangeable filter unit removably mounted in flow-through relation across the top of the housing which is also adapted to be mounted in the apertures on the grid.

7 Claims, 6 Drawing Figures

COMBINATION LIGHTING AND FILTERING UNIT FOR A CLEAN ROOM

BACKGROUND OF THE INVENTION

1. Field of the Invention

The present invention relates to a modular lighting and filtering system for a clean room.

2. Description of the Prior Art

The prior art discloses a variety of lighting and filtering arrangements which can be readily installed in a clean room or the like. For example, U.S. Pat. No. 3,715,578 shows a combination lighting and filtering assembly adapted to be suspended from the ceiling structure of a clean room wherein a pair of lighting members are secured on a cradle which can be pivoted into and out of position beneath the filter media in the assembly to accommodate installation and removal of the lighting members and the filter media. In the typical clean room installation, a plurality of such combination assemblies are suspended from a grid in the ceiling structure of the room. However, since the lighting requirements of the room generally determine how many combination assemblies are used in any particular installation, it has usually been necessary to install additional filter units which do not incorporate any lighting elements to maintain the desired airflow through the room. Consequently, in some installations this has complicated routine installation and replacement procedures due to the additional clamps and the like required to assemble the installation. Moreover, since a specified number of the combination assemblies are to be used in each installation, the assemblies generally cannot be used interchangeably with the filtering assemblies in the event one of those components is unavailable.

SUMMARY OF THE INVENTION

The present invention relates to a modular lighting and filtering system for a clean room and in particular to combination lighting and filtering units which can be readily adapted to form a variety of configurations commensurate with the lighting and filtering requirements of a particular clean room.

The combination lighting and filtering units embodying the invention are particularly suited for use in clean rooms having a ventilated ceiling structure wherein clean air is directed downwardly into the clean room through the ceiling structure. Each of the units includes a flow-through light housing having a plurality of lighting members and secured across its interior. Each of the housings is sized to overlie and enclose one of the apertures in a mounting grid provided in the ceiling structure, and a filter unit removably mounted in flow-through relation across the top of the light housing. Additionally, to accommodate forming a variety of different lighting and air filtering arrays in the ceiling structure, the light housings and the filter units are sized to have the same lateral dimensions so they can be interchangeably mounted in the apertures on the mounting grid.

From the foregoing, it can be seen that the invention contemplates a relatively inexpensive and easily manufactured arrangement which can be readily assembled in field to form a variety of different configurations. However, it is to be understood that various changes can be made in the arrangement, form and construction of the apparatus disclosed herein without departing from the spirit and scope of the invention.

DESCRIPTION OF THE PREFERRED EMBODIMENTS

Figure 1:
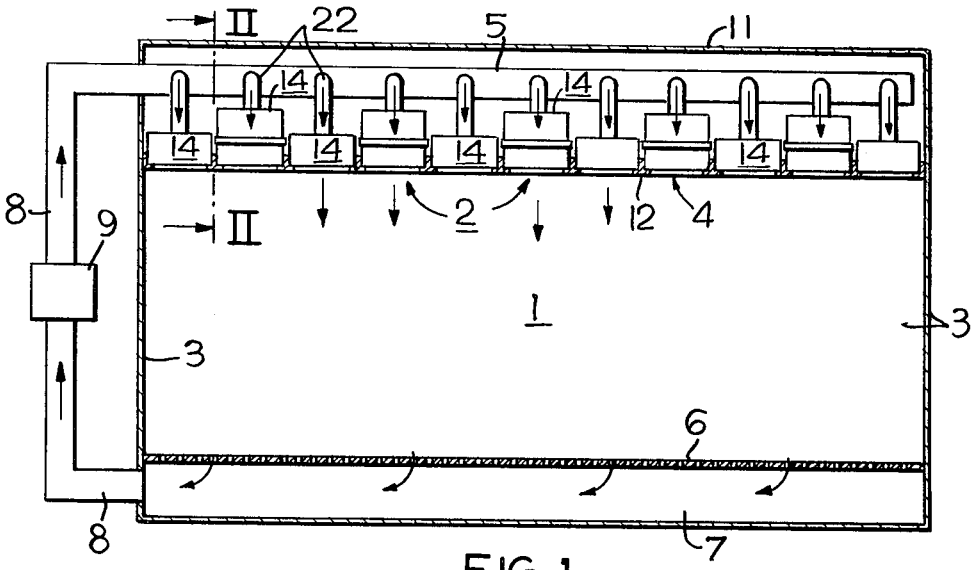
FIG. 1 is a side cross-sectional view of a clean room incorporating the modular lighting and filtering system embodying the invention.
Figure 2:
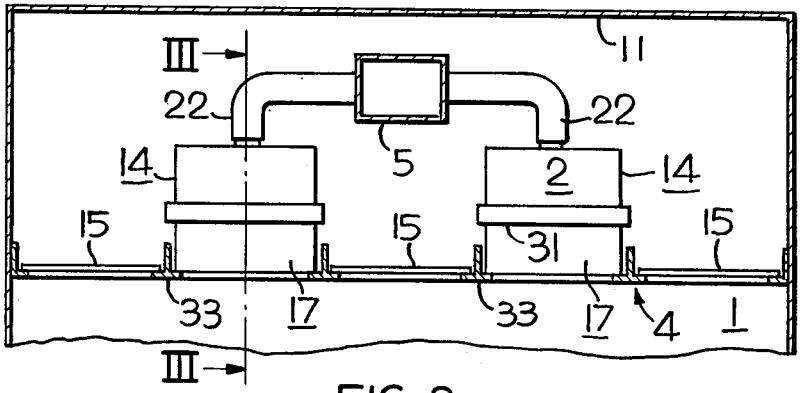
FIG. 2 is an enlarged cross-sectional view taken substantially along line II—II in FIG. 1.

FIG. 1 shows a typical clean room 1 incorporating the combination lighting and filtering units 2 embodying the invention. As shown in the drawing, the clean room 1 includes walls 3, and upper ceiling 11, a ventilated ceiling structure 4, an air supply plenum or duct 5 positioned above the ceiling structure 4, a raised perforated floor 6 defining a return air plenum 7, a return air duct 8 interconnecting the return air plenum 7 and the air supply plenum 5, and a blower 9 in the return air duct 8 adapted to draw an air stream downwardly through the clean room 1 as generally indicated by the arrows in the drawing. Additionally, although not shown in the drawings, it is to be understood that suitable heating, cooling or other air treating equipment is also generally provided in the return air duct 8 to condition the air as desired prior to circulating it back into the clean room 1.

The ventilated ceiling structure 4 includes a horizontal grid 12 of supporting members 13 of an inverted T-shaped cross-section supporting a mixed array of the combination lighting and filtering units 2, filtering units 14 and blank panels 15. In this regard, it should be noted that all of these components have the same lateral dimensions so they can be interchangeably mounted in the apertures 16 formed in the grid 12.

Figure 3:
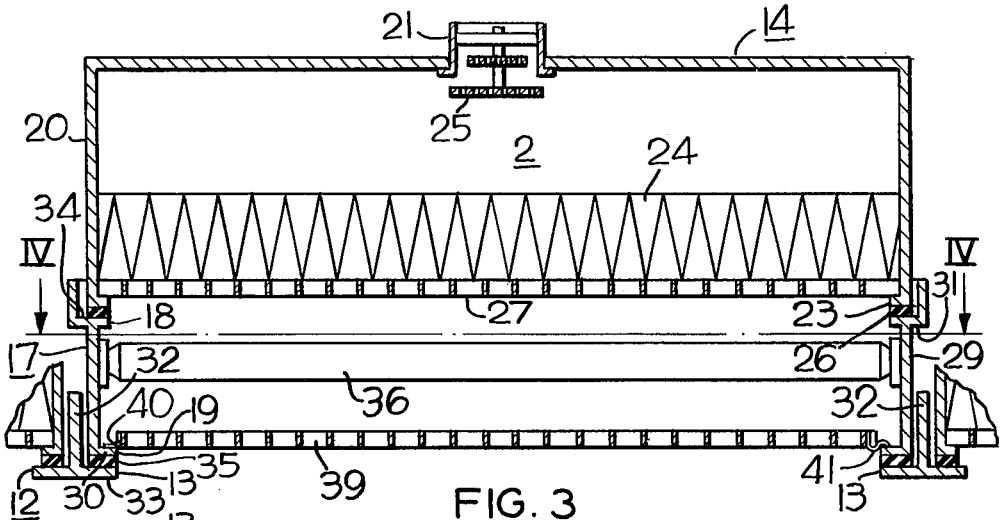
FIG. 3 is an enlarged cross-sectional view taken substantially along line III—III in FIG. 2.
Figure 4:
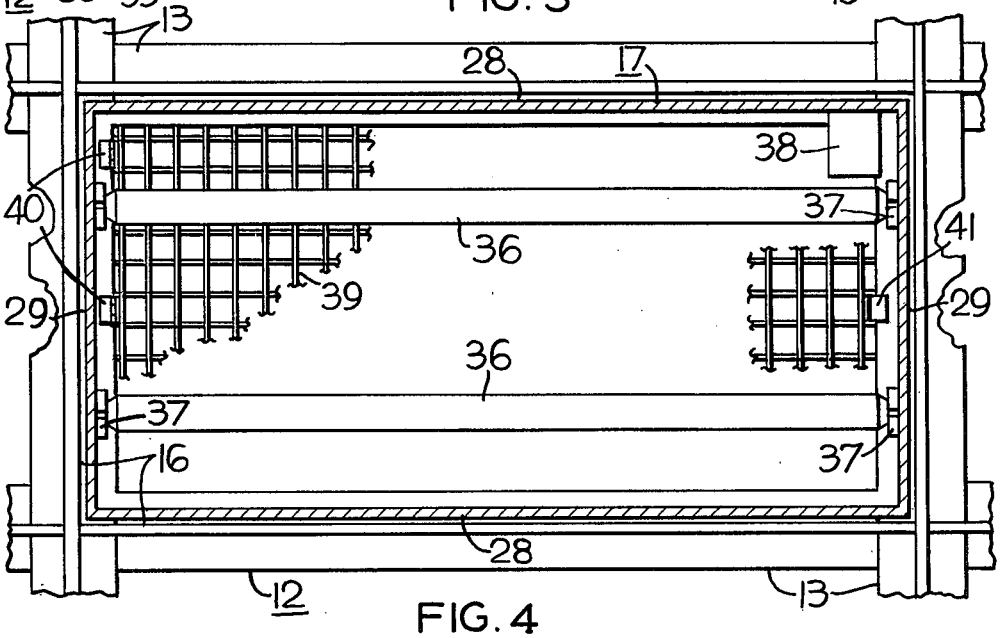
FIG. 4 is a horizontal cross-sectional view taken substantially along line IV—IV in FIG. 3.

As shown in FIGS. 3 and 4, each of the combination lighting and filtering units 2 include a flow-through light housing 17 having an upper inlet 18 and a lower outlet 19 sized to overlie each of the apertures 16, and a filter unit 14 mounted in flow-through relation on the top of the light housing 17. As shown in the drawings, the invention provides for mounting the same filter units 14 on the light housing 17 as those that are mounted directly on the grid 12 in the apertures 16. The filter units 14, which are similar to those disclosed in U.S. Pat. No. 4,061,082, which is incorporated by reference in this specification, each includes a generally rectangular housing or hood 20 having an air inlet duct 21 in its top connected to the air supply duct 5 via ducting 22, and an open bottom forming an air outlet 23 having a suitable panel for filter media 24 secured across it to filter the air as it flows through the filter unit, it being understood any one of a variety of commercially available HEPA type filter media materials can be used for this purpose. Each of the filter units 14 is provided with a baffle or diffuser assembly 25 secured across the inlet duct 21 to disperse the air stream across the entire face of the filter media 24 as it flows into the unit through the inlet duct 21, and a resilient gasket 26 is secured about the bottom periphery of the filter housing 20 which is adapted to form a gas tight seal between the filter housing 20 and the grid 12, or alternatively between the filter unit and the light housing. Additionally, each unit is provided with a flow-through grid-like diffuser screen 27 secured across the outside of the filter media to conceal the media for aesthetic purposes.

Each of the light housings 17 includes spaced side panels 28 interconnected by spaced end panels 29 which are preferably of a uniform cross-sectional configuration including inwardly extending lower flange portions 30 on their lower edges and outwardly offset retaining flange portions 31 forming their upper edges. As shown in the drawings, the light housings 17 are sized to fit between the vertical webs 32 of the supporting members 13 so the lower flange portions 30 overlie the horizontal flange portions 33 projecting from the vertical webs 32, and the filter units 14 are sized to overlie the horizontal seating sections 34 of the retaining flange portions 31. Additionally, a peripheral gasket 35 formed of a suitable resilient material is secured to the lower peripheral edge of the light housing 17 to form a gas-tight seal between the light housing 17 and the grid 12.

Again referring to the drawings, a pair of florescent light bulbs 36 are secured across the interior of each of the light housings 17 in conventional sockets 37 mounted on the end panels 29 which are in turn connected to an electrical ballast 38 and an appropriate power source through suitable electrical wiring (not shown). Additionally, a grid-like diffusing screen 39 is releasably secured in flow-through relation across the lower outlet 19 to conceal the light bulbs within the light housing 17 without interfering with the air flow from the filter unit 14 as it flows through the light housing into the clean room 1. The diffusing screen 29 is secured across the outlet 19 by hinges 40 secured to the lower flange portion 30 extending across one end of the light housing, and a conventional latch 41 provided on the opposite edge of the diffusing screen which is adapted to releasably secure the screen to the lower flange portion 30 to the other end of the filter housing. This arrangement enables a workman to pivot the screen out of the lower outlet 19 so he can readily remove and replace the bulbs 36 from the interior of the clean room.

Figure 6:
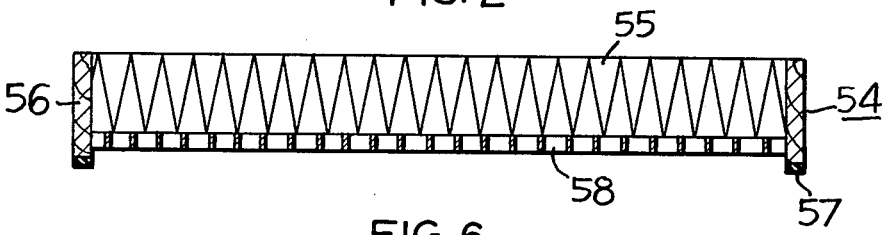
FIG. 6 is a cross-sectional view of the filter panels provided in the alternative embodiment shown in FIG. 5.
Figure 5:
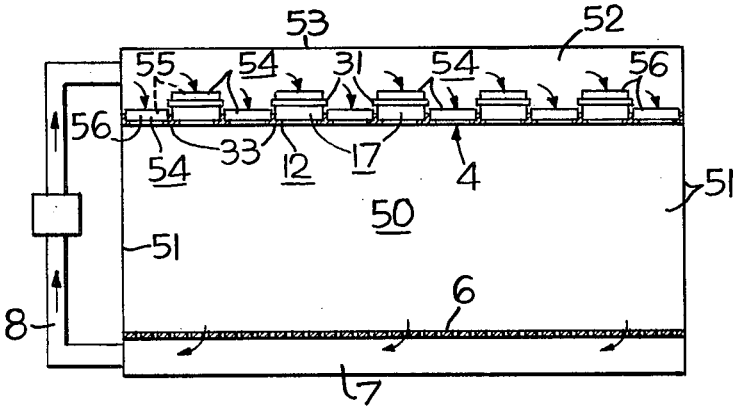
FIG. 5 is a side cross-sectional view of a clean room incorporating an alternative embodiment of the invention.

FIGS. 5 and 6 show an alternative embodiment wherein a clean room 50 includes walls 51, a ventilating ceiling structure 4 defining an air supply plenum 52, a raised perforated floor 6 defining a return air plenum 7, a return air duct 8 interconnecting the air supply plenum 52, and the return air plenum 7, and a blower 9 in the return air duct adapted to circulate an air stream downwardly through the clean room. As in the case of the foregoing arrangement, suitable heating, cooling or other air treating equipment can also be provided in the return air duct 8 to condition the air prior to circulating it back to the clean room.

As shown in the drawings of the alternative embodiment where identical numerals indicate elements substantially the same as those shown in FIGS. 1–4, a horizontal grid 12 is spaced a predetermined distance from the clean room ceiling 53 to form the air supply plenum 52 Thus, suitable filter panels 54, such as the HEPA filter panels sold under the ASTROCEL trademark by the American Air Filter Company can be mounted directly on the offset retaining flange portions 31 of the light housing 17, or alternatively, on the horizontal flange portions 33 of the grid 12. In this regard, it should be noted each of the filter panels 54 includes a panel of filter media 55 secured within an outer rectangular frame 56, and as in the case of the filter unit 14, a suitable gasket 57 is provided about the bottom periphery of each of the frames 56 to form a gas-tight seal between filter panel and the light housing or the grid as may be appropriate, and further, a grid-like diffuser screen 58 is secured across the lower face of the filter media 55 to conceal the media for aesthetic purposes.

From the foregoing, it can be seen the invention contemplates a lighting and filtering arrangement which can be readily assembled in the field to form a variety of configurations commensurate with the lighting and air filtration requirements of a particular clean room. Moreover, the modular character of the arrangement enables a workman to easily modify the arrangement to increase or decrease the lighting level as well as the filtering capacity of the system without any substantial modifications of the filtering and lighting components already in the system.

The embodiments of the invention in which an exclusive property or privilege is claimed are defined as follows:

1. A modular lighting and filter assembly for a clean room in a ceiling structure including a horizontal grid of supporting members of an inverted T-shaped cross-sectional configuration forming a plurality of adjacent apertures having inwardly extending supporting lips about each of their peripheries and modular lighting and filter assemblies and filter units adapted for interchangeable mounting in said apertures, comprising:

a light housing having an upper opening and a lower opening interconnected by a gas passage extending through the housing;

said housing having lighting means supported within the gas passage and including a lower end sized and constructed to fit and mounted in one of said apertures in overlying seating relation to the respective lip of said aperture to support the housing within the grid;

first sealing means adapted to engage the housing about said lower opening and said respective lip to form a gas-tight seal about its associated aperture;

supporting means on said housing surrounding said upper opening; and a filter unit of essentially the same lateral dimensions as said light housing having a second sealing means surrounding its bottom periphery sized and constructed and supportively received by said supporting means of said housing and in selective apertures to support each filter unit selectively on the housing and said aperture and form a gas-tight seal the filter unit.

2. The modular assembly of claim 1, and said filter unit being sized to fit in one of said apertures in overlapping gas-tight seating relation to the respective lip of said aperture to accommodate seating the filter unit within the grid.

3. The modular assembly of claim 1, and said housing and filter unit being of an essentially rectangular configuration.

4. The modular assembly of claim 1, and said housing including an outer wall having an inwardly extending lower flange portion about its lower periphery adapted to engage said first sealing means and an outwardly offset upper flange portion about its upper periphery forming said supporting means.

5. The modular assembly of claim 1, and said housing having a flow-through diffuser panel releasably secured across said lower opening.

6. The modular assembly of claim 1, and said first and second sealing means being resilient gaskets.

7. In a clean room wherein the ceiling structure includes a horizontal grid of supporting members of an inverted T-shaped cross-sectional configuration forming a plurality of adjacent apertures having an inwardly extending supporting lip about each of their peripheries, a modular lighting and filter assembly and filter units adapted for interchangeable mounting in each of a preselected number of said apertures, comprising;

a light housing having an upper opening and a lower opening interconnected by a gas passage extending through the housing including the lighting means for the clean room supported within the passage;

each of said housings having supporting means surrounding its upper opening and including a lower end sized and constructed and mounted in selected one of said apertures in overlying seating relation to the lip of said aperture to support the housing within the grid;

first sealing means surrounding the lower opening of each housing sandwiched between the housing and the lip of the aperture it is supported in to form a gas-tight seal about said aperture; and a flow-through filter unit including second sealing means and supported structure about its bottom periphery sized and constructed to fit interchangeably on said supporting means of said housing and in said apertures; wherein one of the filter units supportively received on the supporting means of each of the housings so said second sealing means forms a gas-tight seal between the filter unit and the housing and at leat a portion of the remaining apertures are each covered by a filter unit seated within it so the second sealing means in a gas-tight fashion forms a gas-tight seal between the filter units and the lips of the apertures covered by said units.

* * * * *